United States Patent [19]

Cavanaugh et al.

[11] Patent Number: 4,566,397

[45] Date of Patent: Jan. 28, 1986

[54] CREW BOAT

[75] Inventors: Glenn L. Cavanaugh; William C. Raffield, both of Panama City, Fla.

[73] Assignees: Trio Corporation; Cavanaugh Marine Corp., both of South Port, Fla.

[21] Appl. No.: 731,337

[22] Filed: May 6, 1985

Related U.S. Application Data

[63] Continuation of Ser. No. 318,561, Nov. 5, 1981, abandoned.

[51] Int. Cl.[4] ..... B63B 1/16; B63B 3/00

[52] U.S. Cl. ..... 114/56; 114/65 R; 114/71; 114/343; 114/356

[58] Field of Search ..... 114/125, 343, 65 R, 114/71, 355, 356, 357, 358, 271, 63, 56; 440/39; D12/300, 315

[56] References Cited

U.S. PATENT DOCUMENTS

| | | | |
|---|---|---|---|
| 1,663,347 | 3/1928 | Miller | 114/71 |
| 2,729,183 | 1/1956 | Owen | 114/63 |
| 3,139,060 | 6/1964 | Dane | 440/39 |
| 3,613,630 | 10/1971 | Jacuzzi | 440/39 |
| 4,030,438 | 6/1977 | Telfer | 114/125 |
| 4,263,866 | 4/1981 | Shirley | 114/56 |

OTHER PUBLICATIONS

"120' Wide Body Aluminum Crew/Supply Boats from Swiftships", Swiftship Inc., P. O. Box 1908, Morgan City, LA.

"Work Boat," vol. 39, No. 12, Dec. 1982, pp. 91–95.

*Primary Examiner*—Sherman D. Basinger

*Attorney, Agent, or Firm*—Cushman, Darby & Cushman

[57] ABSTRACT

A multipurpose crew and resupply vessel for use in resupplying off shore installations with men, food and supplies, as well as fuel, water and all of the suplies needed by that offshore installation. The vessel is characterized by a wide, flat boat supporting a continuous precise lift hull structure that rides substantially horizontally in the water with a shallow draft both when loaded and unloaded so as to operate in a very wide variety of types of water and serves as a transfer platform for moving materials, supplies and men from one offshore installation to another and the vessel has fire fighting and other rescue capabilities.

16 Claims, 14 Drawing Figures

CREW BOAT

This is a continuation of application Ser. No. 318,561, filed Nov. 5, 1981, which was abandoned upon the filing hereof.

FIELD OF THE INVENTION

The present invention concerns crew and resupply vessels for servicing offshore installations.

BACKGROUND OF THE PRESENT INVENTION

Over the past decade as oil has become scarcer, the desirability and need to look offshore for additional sources of oil and gas has increased and offshore oil drilling platforms or installations have become very common. Normally crews of upwards of sixty people are employed to operate one of these offshore installations and accordingly a great deal of resupply capability is required. Crews are periodically changed and there is a daily need for food, water and fuel, as well as for boats capable of fighting fires as well as other general purpose work needed. As a result, a variety of various types of vessels have been developed which have been uniquely suited for particular ones of those tasks. In that regard, separate and specifically designed boats have been designed for hauling fuel, others for hauling water, and still others for fighting fires and for running between off-shore installations. Some of these can also carry crews and most include an open cargo deck for hauling crated materials. This has necessitated the use of wide variety of vessels each type being normally leased by oil companies at fairly high rates.

Such boats vary in lengths from 60 to 135 feet and some, in outward appearance and design, are somewhat similar to World War II PT boats, such as set forth and described in Scott-Paine, U.S. Pat. No. 2,288,490. Two patents which show exemplary types of currently used crew boats are Keenan, U.S. Pat. No. Des. 219,556 and McMakin, U.S. Pat. No. 4,156,577.

Scott-Paine discloses a high speed motor boat that has a planing type hull which runs aft from midships and a flared V-shaped hull which runs forward. This boat is of a hard-chine type and is provided with a high free-board forward and a low free-board aft. The chine line dihedral angles from midships aft decrease gradually and the bottom surfaces of the boat from midships aft have a concave cross-section which likewise decreases gradually until the bottom sides are substantially flat near the stern.

Accordingly, when the boat is both loaded and unloaded, the boat lies at an angle other than one that would position the boat substantially horizontal with the surface of the water so that the stern has a deeper draft than the bow. By having the center of gravity substantially at the same point as the center of pressure at the hull, the high free-board condition of forward portion will remain thereby providing a hull that will bore through waves when running at high speed improving the high speed sea worthiness of the vessel.

Keenan and McMakin disclose crew or supply boats which have a deck house in the forward portion and a fairly expansive exposed rear deck area for carrying cargo. As it was true with the Scott-Paine boat discussed above, the chine lines on these boats appear to gradually decrease or fall toward the stern so that when loaded, the forward end of the vessel will rise up while the rear or aft portion of the vessel, which supports the load carried by the exposed decking will fall such that the load is supported.

Neither of these boats or patents suggest the particular combination of elements as set forth herein nor the hull configuration of the present invention, nor that it is possible, with a change in hull design, to include a wide variety of material and liquid handling capabilities such that one supply vessel can perform a variety of functions.

The hull configuration used on known crew boats can support fairly heavy loads on the exposed, rear portion of decking, but it is important for the stern end of these vessels to ride fairly low in the water, not only so that the hull can support the weight on the deck, but so that the propeller, rudder and other control surfaces remain fully in contact with the water during running. Accordingly, to load such known prior art vessels in any other manner especially one that would place additional weight on the forward part of the vessel would disrupt the ability of the boat to properly plane and would jeopardize the boat's proper and desired operation.

Applicants are also aware of Johnson, U.S. Pat. No. 2,244,011, that relates to the construction of a small, wooden boat which includes reinforcing of the hull near the keel area that provides additional storage space on the bottom of the boat for containing the onboard fuel supply for running the engine powering the boat.

Despite this art and the fact that crew boats have been used for some years to supply offshore facilities, none of the crew boats of which applicants are aware have multiple capabilities for performing a variety of tasks nor could such boats be modified to enable them therefor.

SUMMARY OF THE PRESENT INVENTION

Recognizing the resupply problem that has existed in this industry for many years, applicants sought to design a vessel that would perform a variety of functions in terms of being capable of not only, transporting passengers and/or crew members to and from offshore rigs, as well as one that would also, at the same time, haul necessary food stuffs and other supplies for drilling, fuel supplies for the offshore rig, water supplies for use on board the offshore installation and the boats own internal fuel, water and supplies for its crew. At the same time, it was found to be desirable to have this same boat capable of fighting fires that might break out on other supply vessels, off loading ships or on the rigs themselves and to be capable of being a production boat for transporting materials and personnel between rigs and to stand by on a 24-hour basis so that it could operate as an emergency craft.

The present invention begins with a redesigned hull structure that produces continual or continuous precise lift. The hull includes a deep "V" hull design from midships forward and a continuous, precise lift hull from midships aft characterized, however, by a chine line that remains substantially horizontal from midships to the transom and with a constant dihedral angle and a slight V-shape bottom whose bottom surfaces from midships aft remains substantially flat throughout that expanse so as to support substantially greater weight loads.

Other objects, features, and characteristics of the present invention as well as the methods and operation and functions of the related elements of the structure, and to the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PREFERRED EXEMPLARY EMBODIMENT OF THE PRESENT INVENTION

General Boat Details

Figure 1:
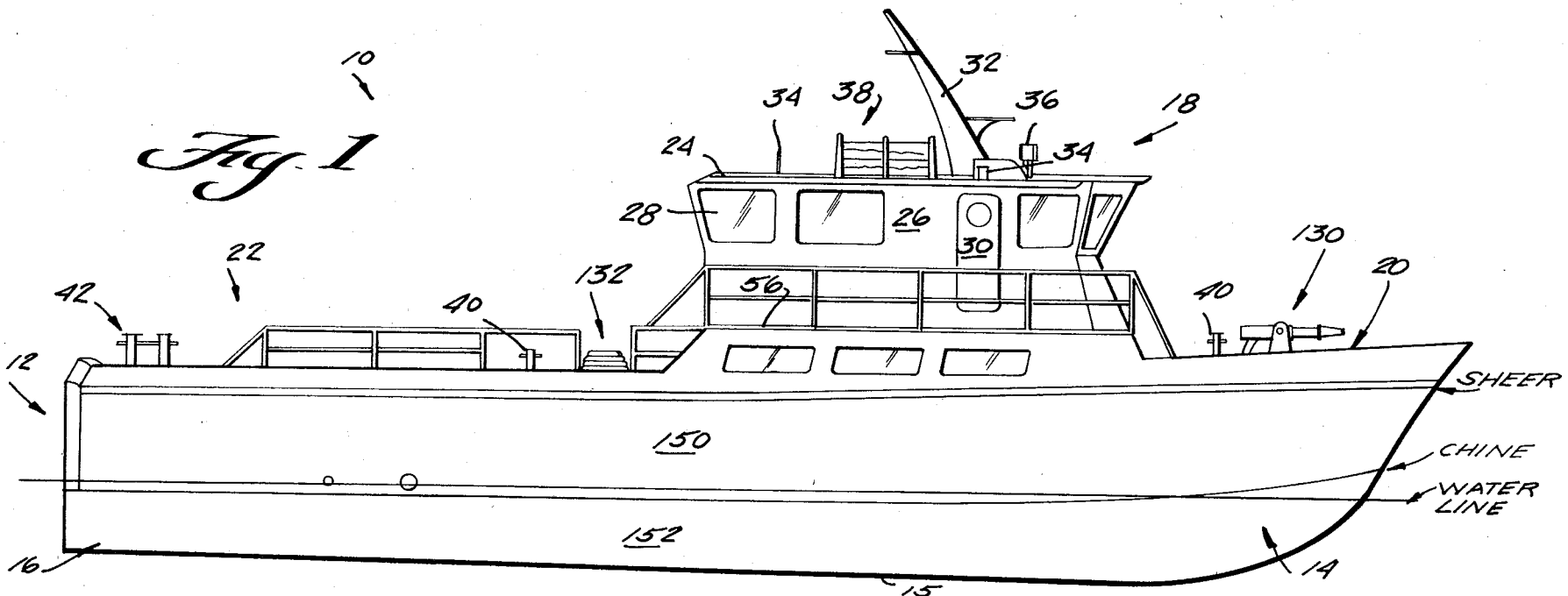
FIG. 1 is a side, elevational view of a vessel according to the present invention.

Turning our attention first to FIG. 1, the boat, according to the present invention, is generally indicated at 10 and includes a hull 12 having a forward section 14 and an aft section 16 and a keel 15 that extends from the fore peak to the transom. The vessel 10 also includes a deck house generally indicated at 18, a forward deck area 20 and a rear cargo deck area 22.

With respect to hull 12, which will be more fully discussed hereinafter, the sheer and chine lines are identified in FIG. 1 and, with reference to FIG. 2, the various stations are shown beginning with FP at the bow and extending back to the transom at 20 with midships being located at station 10. The chine line extends substantially horizontally to the rear from midships or from station 10 toward the transom or aft end of the boat at station 20. This is also clearly shown in FIG. 4 where the various lines are set forth on the graph.

Returning again to FIGS. 1 and 2, deck house 18 includes a roof 24 and vertical side walls 26 which include various windows 28 and doors 30 as are necessary and desirable. Roof 24 serves to support a mast 32 which will provide a support platform for various navigational apparatus, running lights 34, spotlights 36 and lifeboats, generally indicated at 38.

As also shown in FIG. 1, a plurality of cleats 40 are included at various points and a towing bit 42 is included on each side adjacent the aft end of the boat.

Figure 3:
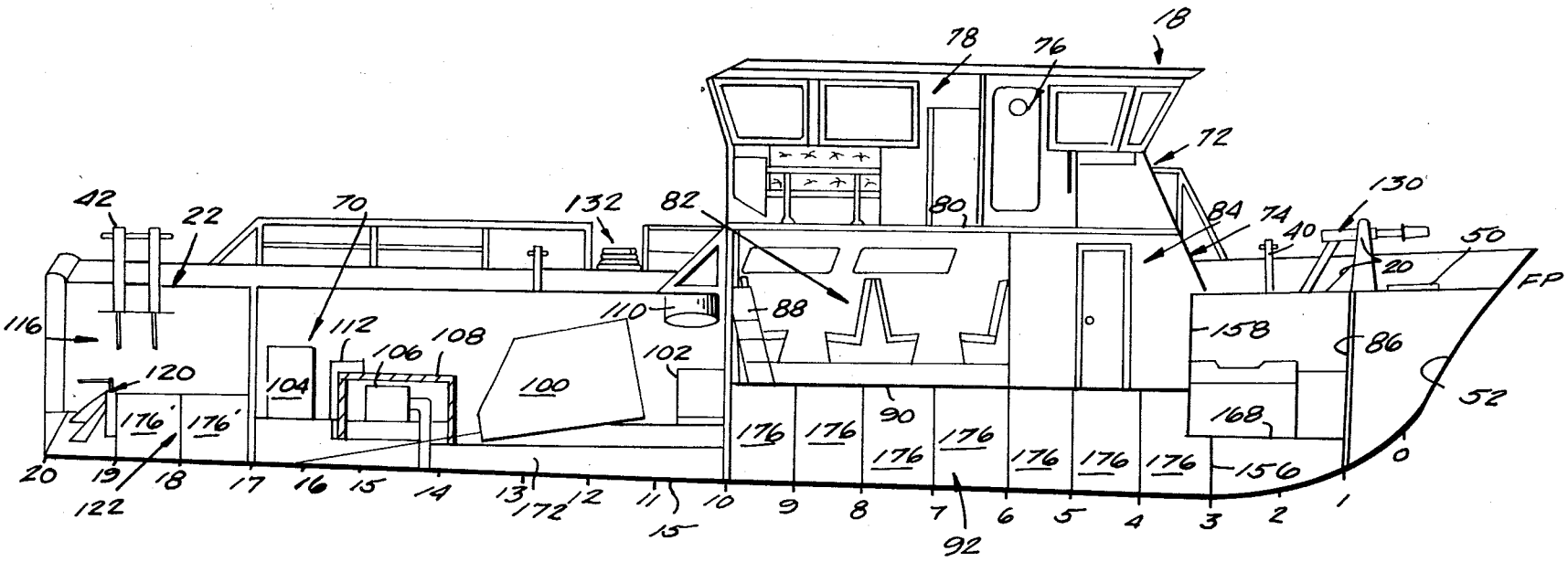
FIG. 3 is a diagrammatic, cross-sectional view of the vessel shown in FIG. 1 showing interior configuration.

While the deck house 18 will be more fully described in conjunction with FIG. 3 it is a two story structure and is positioned above the main liquid storage area of the vessel.

Turning now more specifically to FIG. 2, the top, plan view again shows the roof 24, deck house 18 forward deck area 20 and rear cargo deck 22 which constitutes about 60% of the deck area. In forward deck 20 there is a hatch cover 50 which leads to a hold area indicated at 52 best shown in FIG. 3. Preferably hold area 52 would be used as a rope locker, but it could have other storage uses as well.

The main bulkheads are found at stations 1, 10 and 17, respectively, shown in FIGS. 6, 9 and 11 and these will be more fully discussed hereinbelow.

Forward deck 20 also includes cleats 40, discussed above, and leads directly into deck areas 54 and 56 on the port and starboard sides, respectively, of deck house 18.

Deck 20 is comprised of 3/16th aluminum plating while cargo deck 22 has 5/16ths inch aluminum plating as its base and is overlaid with 2 inch wide cyprus lumber 58 which is held in place along the center of cargo deck 22 by means of a T-strip 60 along which a plurality of cargo tie down 62 are also secured.

The aluminum plating in cargo deck 22 is provided with three hatches 64, 66 and 68 with hatches 64 and 66 being shown through the cutout portions in the cyprus decking 58 whereas hatch 68 is shown in phantom. These three hatches 64, 66 and 68 provide access into the engine compartment indicated in FIG. 3 at 70 and are suitably sized to allow the removal of engines, generator and/or pump equipment from that area.

With reference still to FIG. 3, deck house 18 is comprised of an upper portion generally indicated at 72 and a lower portion generally indicated at 74. Upper portion 72 is divided into a forward cabin 76, where the forward control and steering functions can be carried out, and an aft cabin 78 designed to include a galley, passenger compartment space and an aft steering station. A floor 80 separates the upper and lower portions of the deck house 18.

The lower portion 74 of deck house 18 is also divided up into a plurality of separate compartments or cabins with the aft cabin area again being designed for accomodating passengers, specifically the crews being transported. A forward cabin 84 is the head and includes sinks, showers and toilet facilities. Located forward of this lower portion 74 of deck house 18 is a forward cabin 86 which provides quarters for the crew operating the boat and can include suitable bunk space and closet areas for a crew of up to four individuals. This interior passager space constitutes about 45% of the internal volume.

Stairs 88 are preferably installed adjacent the bulkhead at station 10 and extend through floor 80 so as to provide access between the upper and lower portions 72 and 74 deck house 18.

Located beneath the floor 90 of lower compartment 74, which can be 3/16ths aluminum plate is the main auxillary tank structure, generally indicated by reference numeral 92, and this area extends from station 10 forward to station 3 and across the full width or beam of the vessel beneath floor 90 so as to occupy about 5 to about 10 percent of the interior area of the boat. The compartment formed beneath crew quarters 86 and between the bulkheads at stations 3 and 1 is empty and is provided for floatation purposes.

Engine room 70 includes at least two diesels, one of which is indicated at 100, with each preferably being either a 12 V 92 or 8 V 92 Detroit diesel manufactured by Detroit Diesel in Detroit, Mich. or any other desired power source of a comparable size. Included as well within engine compartment 72 are air conditioning units 102, a generator 104, and a separate fire fighting engine 106 which can be a 53 series Detroit diesel engine. A work table 108 can also be included along with a forced air intake 110 for the various diesels and various tanks 112 for dry chemicals for use in fighting fires. Generator 104 is driven by its own self-contained diesel which will be connected into the fuel supply as will be more fully discussed hereinafter. Diesel 106 powers a separate fire pump 114, indicated in the piping diagram set forth in FIG. 14. The engine room will also include a floor constructed from ¼" tread plate, with this floor extending about the entire area except for where the engines are located.

Located behind the bulkhead at station 17 is an aft compartment, generally indicated at 116, often referred to as the lazaret.

Figure 2:
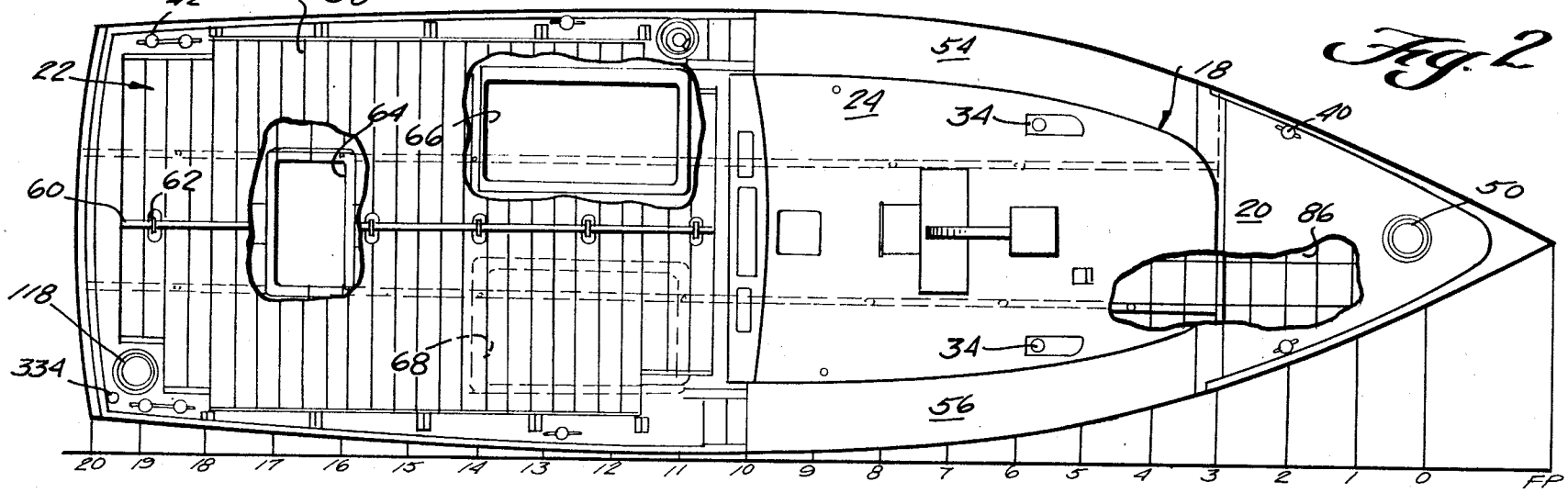
FIG. 2 is a top, plan view of the vessel shown in FIG. 1 with portions having been cut away for clarity.

The top decking 22 serves at the top closure for this chamber as well as the engine room area entry to the former being provided through hatch 118 as shown in FIG. 2.

The lazaret can contain storage capacity for a variety of types of equipment and supplies and contains as well the rudder control mechanism generally indicated at 120. Included in this area as well are additional tankage assemblies generally indicated at 122 whose construction is the same as the tanks indicated at 92 with both being described hereinafter. The tank assemblies 122 in the lazaret or aft portion of the boat can be used to store the onboard fuel requirements for this vessel so that the storage facilities and tanks 92 will provide storage space for transporting offboarded supplies of fuel, water or combinations of fuel and water to the offshore installation being serviced.

With reference still to FIGS. 1-3, fire pump 114 will be connected via suitable piping (not shown) to both a fire gun assembly, generally indicated at 130, mounted on the forward decking 20 so as to be capable of fighting fires and to a plurality of hoses, one of which is indicated at 132 amidships.

Hull Details

Figure 4:
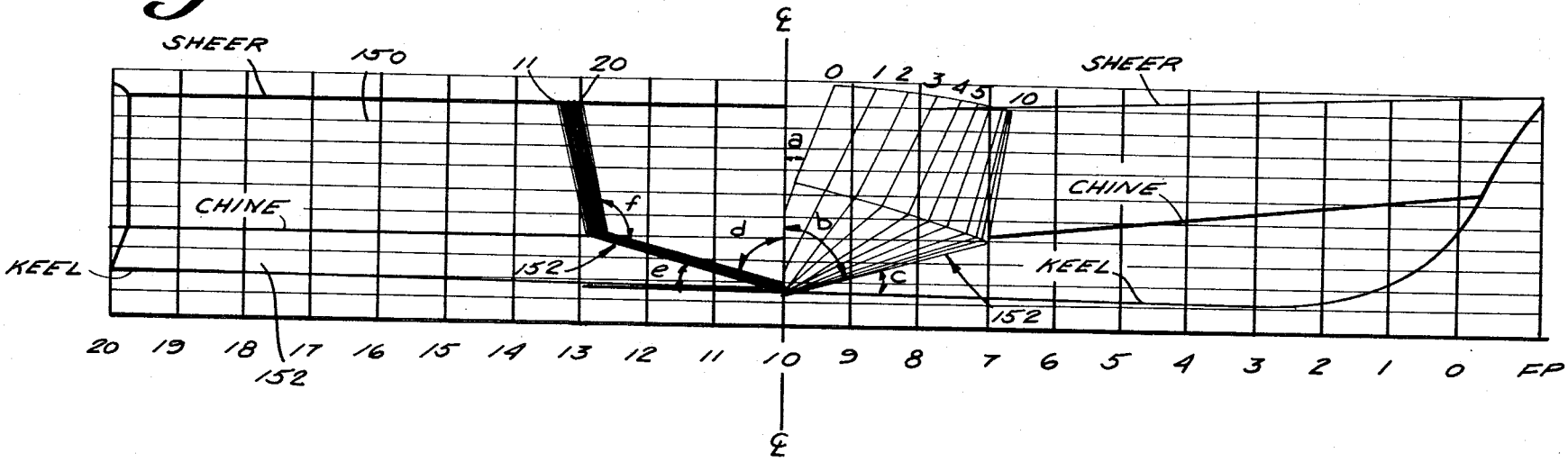
FIG. 4 is a side, elevation showing the lines of the hull together with transverse sections of the hull at various stations as indicated in this Figure and FIG. 2.
Figure 5:
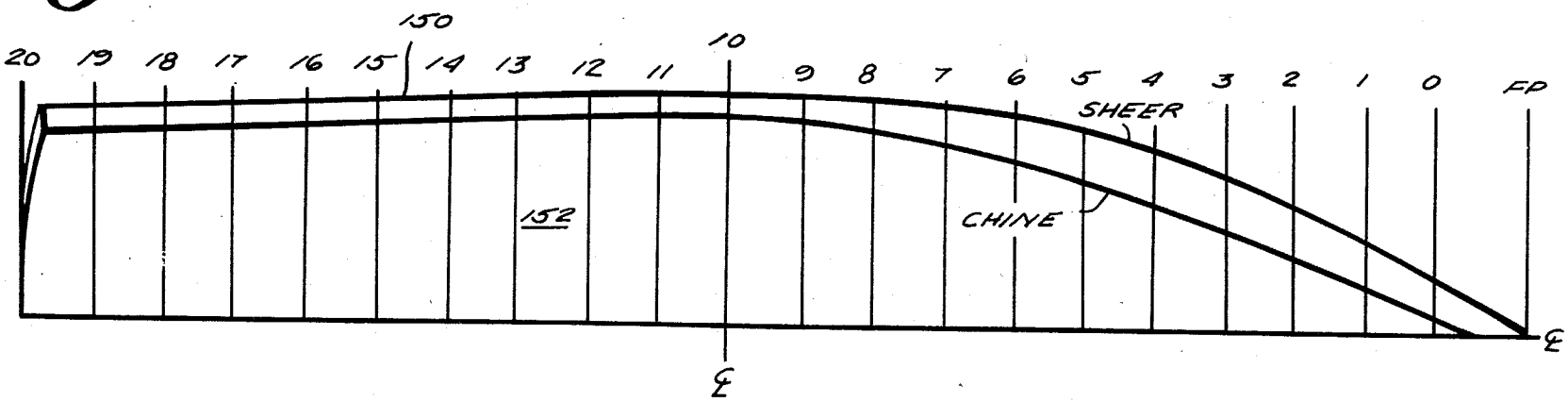
FIG. 5 is a partial, plan view showing the sheer and chine lines of the hull.

With reference now to FIGS. 4 and 5, the side elevation, transverse section and bottom plan views of the hull indicate clearly that the forward portion of the hull gradually changes from that of a deep V hull at the forward end beginning adjacent stations zero and one toward the widest beam of the boat at station 10 where the beam is about 20 feet at the sheer line and about 18 feet at the chine line. It will be noticed that from station 10 aft, the angle between the bottom surface, generally indicated at 152, and the vertical center line of the boat, as well as between the bottom surface 152 and the sides generally indicated at 150 remains constant. While the sides 150 extend outwardly from the vertical so as to provide additional decking area at the sheer line it should also be noticed that the bottom and side surfaces of the vessel are flat notwithstanding there angular positioning with respect to the center line. It is this feature together with the angular relationship between these surfaces of the hull that produces the unique, continual, precise lift characteristics of this hull construction that allows this hull to operate as desired.

As is clear from the bottom plan view in FIG. 5, the vessel has its maximum beam located amidships at station 10 with the chine and sheer line thereafter converging toward one another so that at the transom, the beam of vessel at the sheer is about 18 feet, as compared with about 20 feet amidships and the beam at the chine is about 16 feet as compared with about 18 feet amidships. Thus, the beam at the transom is approximately 90% of the maximum beam amidships.

It should also be noted with respect to FIG. 4, that the transverse section lines for the sections from stations 11 through 20 are parallel to one another with the separation therebetween corresponding to the changing beam width from station 11 back to the transom at station 20 referred to above with respect of FIG. 5.

With reference continuing to FIG. 4 and specifically the transverse section lines, angles "a" through "f" have been designated and these angles can be defined as having the following ranges. Angle "a" is the angle between the vertical center line of the vessel and the slope of both the side and bottom wall at station 0 with that angle being approximately 20 degrees, plus or minus about 2.5 degrees.

Angle "b" corresponds to the angle between the vertical center line of the vessel and the bottom plates forming the bottom surface at station 10, with angle "b" being about 76 degrees, plus or minus about 2.5 degrees.

Angle "c" is complementary angle with respect to angle "b" to a line perpendicular to the center line with angle "c" being about 14 degrees, plus or minus about 2.5 degrees.

Angle "d" corresponds to the constant angle between the bottom plates forming the bottom surfaces of the vessel from stations 11 aft to station 20 and the vertical center line of the vessel with angle "d" also being about 76 degrees, plus or minus about 2.5 degrees, so that it also is about the same angle as that exhibited by the bottom at station 10.

Angle "e" is the complementary angle to angle "d" with respect to a line normal to the center line and this angle will also remain constant throughout stations 10 to 20 at about 14 degrees, plus or minus about 2.5 degrees or an angle that can range between about 11° to about 17°.

Angle "f" is the angle between the side wall 150 and the bottom surface 152 at each of the stations from station 11 aft to station 20 with angle "f" being about 24 degrees, plus or minus about 2.5 degrees.

FIG. 4 also shows that the keel 15 has its lowest point at approximately stations 3 and 4 with the keel rising slightly as it extends aft toward the transom at station 20. Keel rise will be approximately 21 inches for a 50 foot span and approximately 40 and 80 inches for a 100 and 200 foot spans, respectively.

With respect to these line drawings in FIGS. 4 and 5, included below is a table of offsets for each of the various stations giving the measurements from the base line to the keel, chine, sheer and from the center line to the sheer.

TABLE OF OFFSETS

| Stations | 0 | | | 1 | | | 2 | | | 3 | | | 4 | | | 5 | | | 6 | | | 7 | |
|---|---|---|---|---|---|---|---|---|---|---|---|---|---|---|---|---|---|---|---|---|---|---|---|
| Base Line to Keel | 5 | 0 | 0 | 2 | 5 | 0 | 1 | 6 | 0 | 1 | 4 | 0 | 1 | 4 | 4 | 1 | 5 | 2 | 1 | 6 | 0 | 1 | 6 | 2 |
| Base Line to Chine | 6 | 4 | 4 | 6 | 0 | 4 | 5 | 8 | 4 | 5 | 5 | 0 | 5 | 1 | 6 | 4 | 10 | 4 | 4 | 7 | 6 | 4 | 5 | 0 |
| Base Line to Sheer | 10 | 10 | 0 | 10 | 7 | 4 | 10 | 6 | 4 | 10 | 5 | 4 | 10 | 4 | 0 | 10 | 2 | 6 | 10 | 2 | 0 | 10 | 1 | 0 |
| Center Line to Chine | 0 | 5 | 2 | 1 | 9 | 0 | 3 | 1 | 0 | 4 | 3 | 0 | 5 | 4 | 4 | 6 | 4 | 2 | 7 | 2 | 2 | 7 | 10 | 4 |
| Center Line to Sheer | 2 | 2 | 6 | 3 | 10 | 0 | 5 | 3 | 4 | 6 | 7 | 0 | 7 | 7 | 4 | 8 | 5 | 2 | 9 | 0 | 4 | 9 | 6 | 0 |

| Stations | 8 | | | 9 | | | 10 | | | 11 | | | 12 | | | 13 | | | 14 | | | 15 | |
|---|---|---|---|---|---|---|---|---|---|---|---|---|---|---|---|---|---|---|---|---|---|---|---|
| Base Line to Keel | 1 | 6 | 6 | 1 | 7 | 2 | 1 | 8 | 4 | 1 | 8 | 4 | 1 | 9 | 0 | 1 | 9 | 2 | 1 | 9 | 6 | 1 | 10 | 0 |
| Base Line to Chine | 4 | 2 | 6 | 4 | 1 | 0 | 4 | 0 | 0 | 4 | 0 | 0 | 4 | 0 | 0 | 4 | 0 | 0 | 4 | 0 | 0 | 4 | 0 | 0 |
| Base Line to Sheer | 10 | 0 | 4 | 10 | 0 | 1 | 10 | 0 | 0 | 10 | 0 | 0 | 10 | 0 | 0 | 10 | 0 | 0 | 10 | 0 | 0 | 10 | 0 | 0 |
| Center Line to Chine | 8 | 5 | 4 | 8 | 10 | 0 | 9 | 0 | 0 | 8 | 11 | 0 | 8 | 10 | 0 | 8 | 9 | 0 | 8 | 8 | 0 | 8 | 7 | 0 |
| Center Line to Sheer | 9 | 9 | 4 | 9 | 11 | 4 | 10 | 0 | 0 | 9 | 11 | 0 | 9 | 10 | 0 | 9 | 9 | 0 | 9 | 8 | 0 | 9 | 7 | 0 |

| Stations | 16 | | | 17 | | | 18 | | | 19 | | | 20 | | | FP | | |
|---|---|---|---|---|---|---|---|---|---|---|---|---|---|---|---|---|---|---|
| Base Line to Keel | 1 | 10 | 4 | 1 | 11 | 0 | 1 | 11 | 4 | 2 | 0 | 0 | 2 | 0 | 0 | | | |
| Base Line to Chine | 4 | 0 | 0 | 4 | 0 | 0 | 4 | 0 | 0 | 4 | 0 | 0 | 4 | 0 | 0 | | | |
| Base Line to Sheer | 10 | 0 | 0 | 10 | 0 | 0 | 10 | 0 | 0 | 10 | 0 | 0 | 10 | 0 | 0 | 4 | 0 | 0 |
| Center Line to Chine | 8 | 6 | 0 | 8 | 4 | 6 | 8 | 3 | 4 | 8 | 1 | 6 | 8 | 0 | 0 | | | |
| Center Line to Sheer | 9 | 6 | 0 | 9 | 4 | 6 | 9 | 3 | 4 | 9 | 1 | 6 | 9 | 0 | 0 | | | |

A variety of specific cross-sections are set forth in FIGS. 6–12 and reference to FIGS. 2 and 3 would be helpful for appreciating the point at which each of these cross-sections have been taken.

Figure 6:
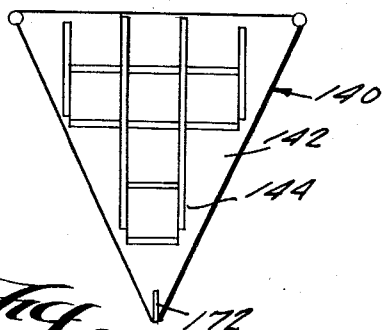
FIG. 6 is a cross-sectional view of the vessel showing the crash bulkhead at station 1.

FIG. 6 corresponds to the cross-section at station 1 and shows a crash bulkhead, generally indicated at 140. This is a water tight bulkhead constructed of ¼ inch aluminum plate forming the primary member 142 and is preferably reinforced with a network of 2 inch aluminum angle irons 144.

Figure 7:
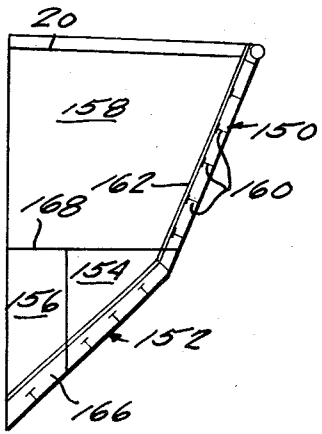
FIG. 7 is a showing of a partial, cross-section at station 3.

FIG. 7 discloses the cross-section at the beginning of the tank structure indicated at 92 in FIG. 3. The side of the vessel is indicated at 150 with the bottom surface being indicated at 152. FIG. 7 only shows half of the vessel's width, but as indicated in FIG. 3, this cross-section is looking toward the transom. Accordingly, it shows two end walls of the tanks 92, those end walls being identified respectively as 154 and 156. Likewise, wall 158 of compartment 86, which constitutes the crew quarters, is also shown as is the forward deck 20 which forms the ceiling for crew quarters 86.

Figure 13:
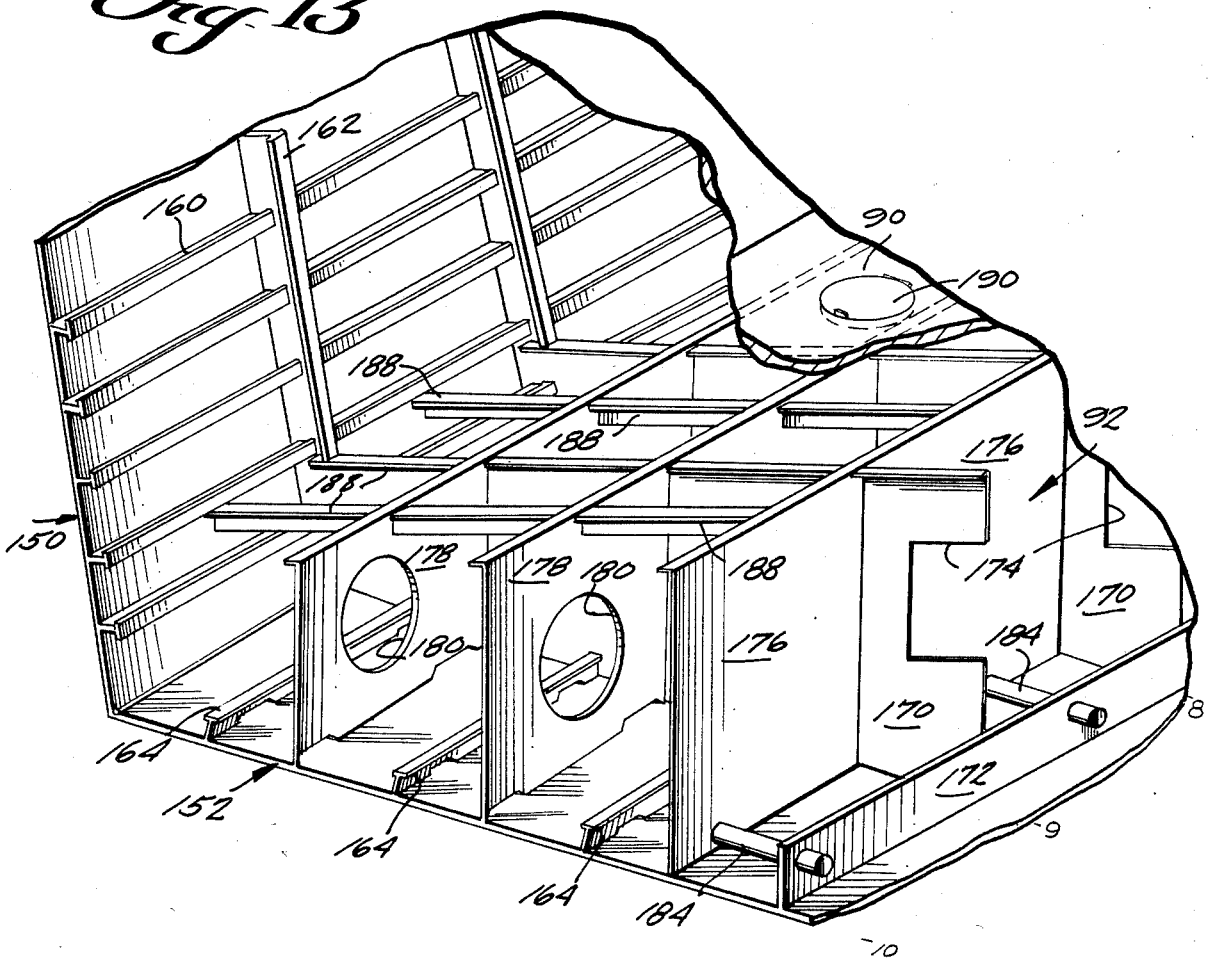
FIG. 13 is a diagrammatic, perspective view of a portion of internal integral tank structure construction detail.

The structure of sides 150 of the vessel is constructed from ¼ inch aluminum plating from station 10 aft and from 5/16th inch aluminum plating from station 10 forward. As shown in FIG. 13, side walls 150 of the vessel are also reinforced by longitudinally extending T members 160 welded in place on 12 inch centers with the T members 160 being constructed as 3 inch by 1.5 inch by 2.5 inch aluminum Ts.

Preferably, all the aluminum used throughout the construction of the vessel is 5086 Marine grade aluminum alloy although other metals or materials such as 6063 aluminum could also be used.

The sides 150 also include transversely extending T's 162 which extend upwardly along and in contact with the side wall. These transverse T's are constructed as 6"×2"×5/16" T's and are welded in place to both the side wall and to the longitudinal T's 160 in the manner shown in FIG. 13 to form an integrated reinforcing network.

Likewise, longitudinal T members 164 extend along bottom 152 in a direction preferably parallel with the keels 15 and the for and aft center line of the vessel. The longitudinal T's in the bottom are constructed again from the 3"×1.5"×2.5" T's and are preferably welded into place on 12" centers. Transversely extending T's 166 are also used on the bottom of the vessel at least in those portions of the vessel not otherwise occupied by the tankage structure 92 such as in the area immediately ahead thereof as shown in FIG. 7.

Also shown in FIG. 7, is the floor 168 of chamber 86 which serves as the crew quarters area with that floor being comprised of 3/16" aluminum plating.

Figure 8:
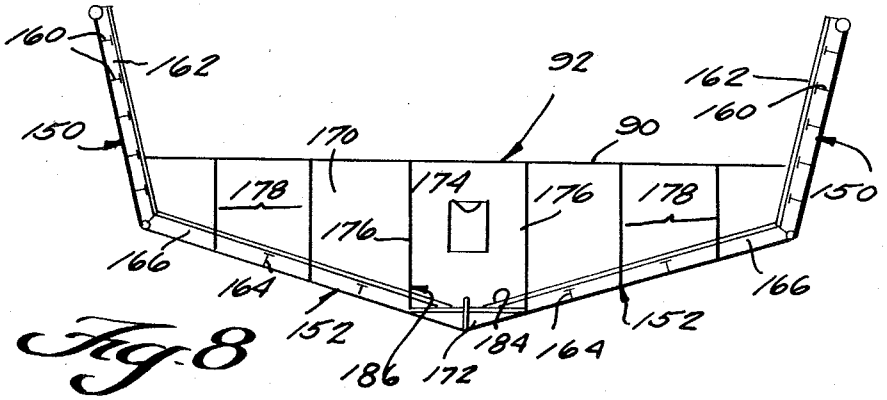
FIG. 8 is a cross-section of the vessel at station 8.

With reference now to FIGS. 3, 8 and 13, the tankage construction, generally indicated at 92, can be understood.

The tankage compartments 92 extend primarily under deck house 18 or more specifically under the passenger space comprised of the lower deck housing 74 with floor 90 separating the cabin compartments from the tanks. Floor 90 is preferably made from 3/16" aluminum plate and serves both as the floor to the interior compartments, as well as the cover over the tankage construction 92. The bottom of each of the tanks is comprised of the vessels bottom plating 152 and the outside wall of each of the tanks is formed by the lower portion of the plating 150 forming the side walls of the vessel, as is clearly shown in FIG. 13. The remaining portions of the vessel are formed by transversely extending plates 170 which extend transversely from side of the vessel to the other. As may be noted in FIG. 13, plates 170 adjacent keel 172, which runs for and aft along the center line of the vessel from the fore peak to the transom, are provided with cutouts 174 which provide a race way along which the pipes and other wiring can be strung.

Extending longitudinally in a direction substantially parallel with keel 172, are a plurality of separate baffle plates some of which are solid, as indicated at 176 which form the inboard boundary of the port and starboard side tanks by being welded on either side of keel 172 and spaced therefrom. Other intermediate baffles that retard movement are indicated at 178 and are provided with a circular opening 180 which is large enough to allow an individual to crawl therethrough. In order to assure any type of liquid held in the tanks can be properly drained, scuppers 182 are provided in both the longitudinally extending T members 164 and in baffle plates 178 so that liquid held in the tanks can move freely back and forth and during draining to permit full draining and proper movement of the liquid in the tanks.

Figure 14:
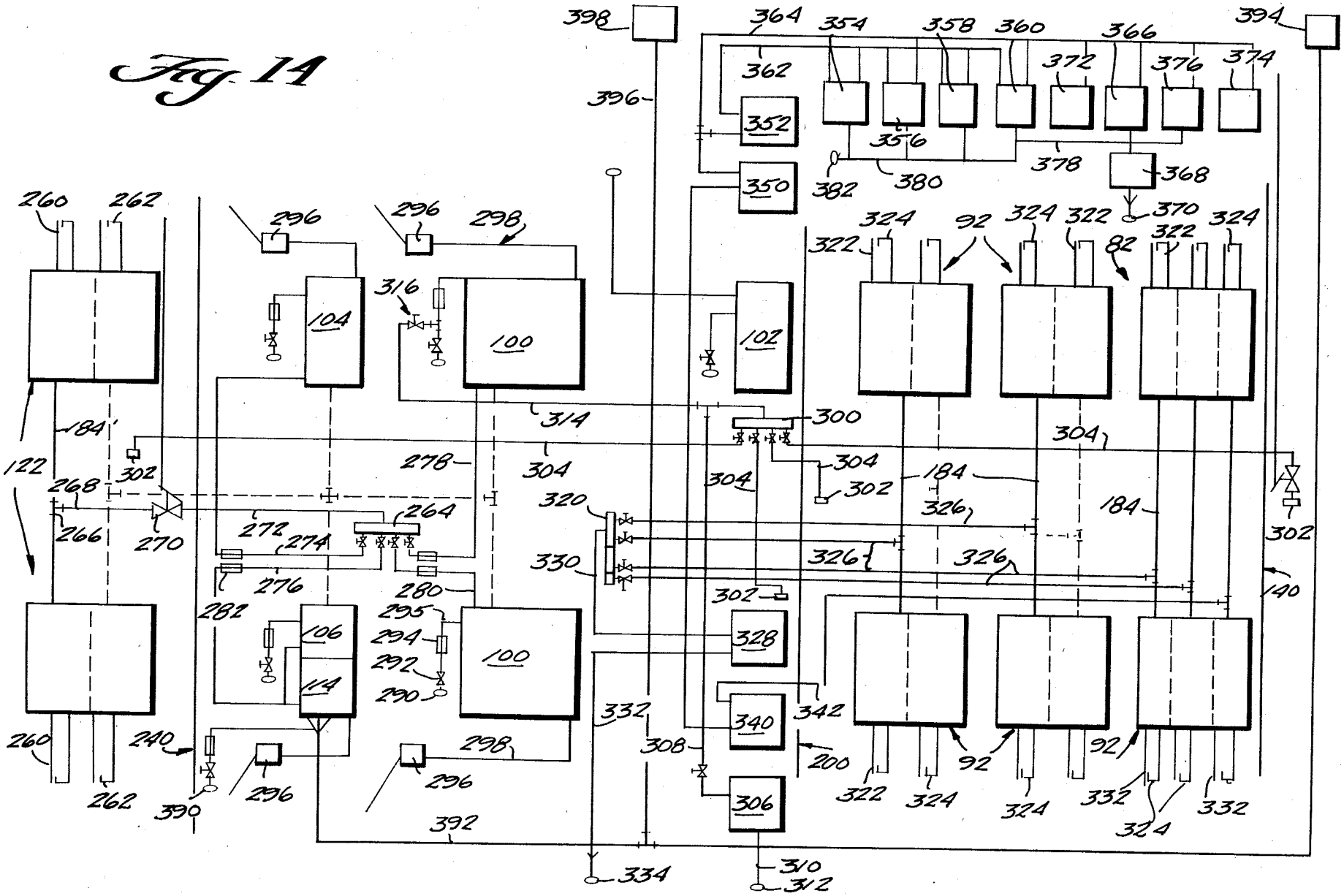
FIG. 14 is the piping layout for the vessel.

Also, shown in FIG. 13 and referred to more specifically in the piping diagram shown in FIG. 14, are conduits such as indicated at 184 which extend from the solid plates 176 forming the inboard side of the tanks and extending across the chamber formed between plates 176, such as shown in FIG. 8 at 186. Conduits 184 allow flow of liquids from a tank on one side of the vessel to the opposite tank on the other side of the vessel so that during running, the liquid in each of the two tanks can reach a common level thereby maintaining or allowing proper trim of the boat to be achieved. The tanks 92 are, accordingly, paired together across the vessel so that the type of material held in each of the opposing pairs of tanks must be the same for each pair.

While it is preferred that wall members 170 comprise one piece structural elements which extend across the entire beam width of the vessel, at the appropriate station at which they are placed, and that solid plates 176 and baffle plates 178 be welded to them, it should be understood, however, that each of various plates could be separate with all the seams in any event formed between the side and bottom surfaces between floor 90 and between each of the baffle plates or walls 170, 176 and 178 be all waterproof welded seams so as to form a strong structural unit.

To improve the structure and to provide more support for floor 90, transverse T beams, such as indicated in FIG. 13 at 188 are welded across baffles 178 and from side 150 to the first outboard baffle 178.

As indicated in FIG. 13, a hatch 190 is also included over each separate tank so that access can be obtained into the tanks to allow cleaning to take place.

As shown in FIG. 3, there are seven pairs of tanks that together allow approximately 6,000 gallons of liquid materials to be transported. While a variety of differently sized tanks might be used, we prefer to have the distance along the vertical centerline from keel 172 to the bottom of floor 90 be about 3 feet while the outside vertical dimension of the tanks along the outer hull are 2'0" from floor 90 to the corner between bottom 152 and sidewall 150. Baffles 176 can be about 3'0" by 4'0" while baffles 178 can be about 3'0" by 4'0". Under Coast Guard regulations, if the tank defined between stations 9 and 10 were to carry fuel and it was desired to have the remaining tanks carry water, the tank spanning between stations 8 and 9 across the entire width of the vessel would have to remain empty so that the seams along both stations 9 and 8 could be checked to be sure that there was no leakage that could result in contamination between the two sets of tanks. If, on the other hand, all of the tanks were to carry the same type of liquid, then each of the sets or pairs of tanks could be filled to their respective capacities. It should be understood that a variety of types of liquids and various tanks combinations can be employed to carry whatever amounts and quantities of liquid supplies are needed by any particular offshore installation.

Onboard fuel supplies contained in area 122 back in the lazaret is also comprised of a plurality of pairs of port and starboard tanks constructed in a manner similar to that described above with respect to tanks 92.

Figure 9:
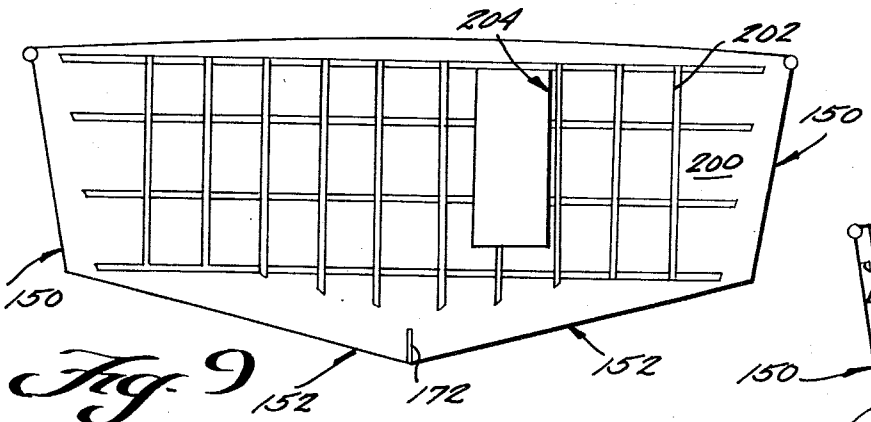
FIG. 9 is a cross-section of the vessel showing the bulk head at station 10.

Turning now to FIG. 9, the bulkhead at station 10 is set forth and is comprised of a main wall area 200 constructed from ¼" aluminum plating on which a reinforcing grid structure 202 is formed, again preferably from 2" angle iron bars. In order to allow access between the engine compartment 70 and the aft cabin or passenger compartment 82, a doorway 204 is provided in the main wall 200 of the bulkhead at station 10. Suitable stairs or steps (not shown) would be also employed to provide an easy access back and forth and a watertight door (not shown) of conventional construction would also be used to make this bulkhead waterproof.

Figure 10:
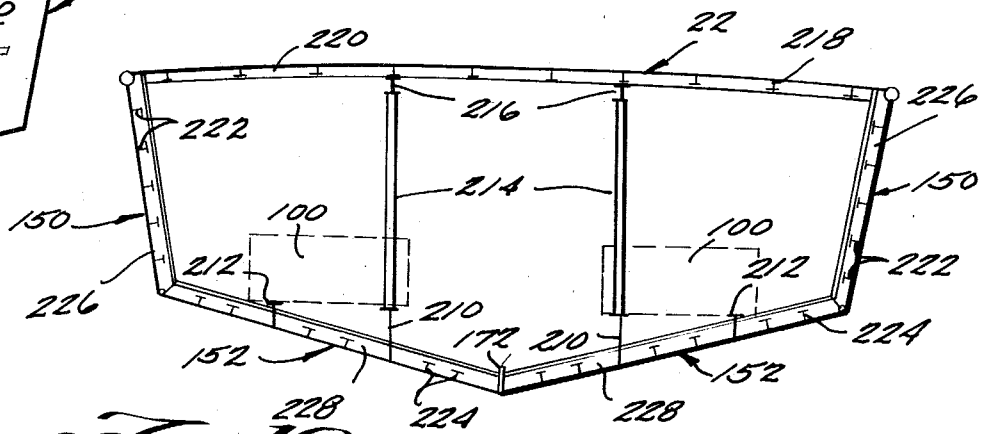
FIG. 10, is a cross-section of vessel at station 11.

FIG. 10, as shown in FIG. 3, corresponds to a cross-sectional view at station 11 and shows the engine compartment at that point. Engines 100, as shown in phantom, are each supported by an inboard flat bar keelson 210 which extends longitudinally parallel to the center keelson 172 and an outboard flat bar keelson 212 which also extends parallel to keelson 210. It should be understood that flat bar keelsons 210 and 212 extend longitudinally a sufficient distance to provide a proper mount for these engines. Additional similar engine mounts can be used for the generator 104 and fire pump engine 106 shown in FIG. 14.

The cargo decking 22 is supported from within or across the engine compartment 70 by a plurality of vertical supports 214, each of which is welded between the inboard keelsons 210 and longitudinally extending I-beams 216 which are in turn welded beneath deck beams 220 with the latter supporting the plating forming cargo deck 22. For added support for the cargo decking, longitudinally extending T beams 218 are welded together with the transversely extending deck beams 220 to form a reinforcing grid structure on the bottom surface of the plates forming cargo deck 22.

I-beams 216 are preferably 6"×3"×⅜" aluminum I-beams whereas deck beams 220 are ⅜"×4" T beams.

T beams 218 in the cargo decking area are preferably 4"×2"×¼" T's and similar T's 222 are used in the sides 150 of the vessel at this point so as to provide improved strength and reinforcing in the portion of the hull extending aft from station 10. Similar reinforcing T's 224 are used in the bottom structure 152.

In addition, transversely extending beams 226 in sides 150 of the vessel and 228 in the bottoms are comprised of 6"×2"×5/16" T T's again in an effort to provide improved structural reinforcing of the aft section of the vessel.

Figure 11:
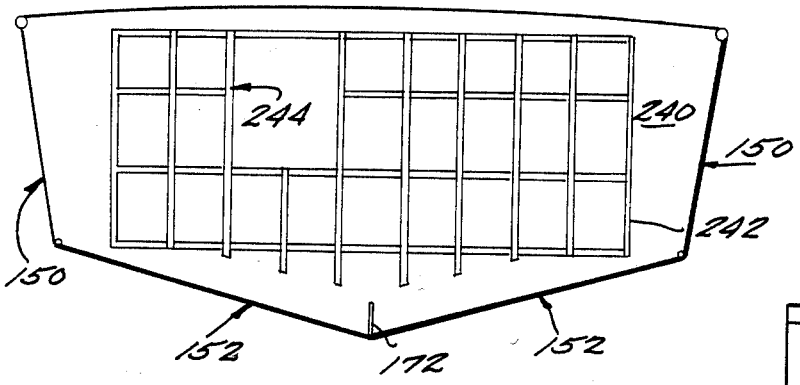
FIG. 11 is a cross-section of the vessel showing the bulkhead at station 17.
Figure 12:
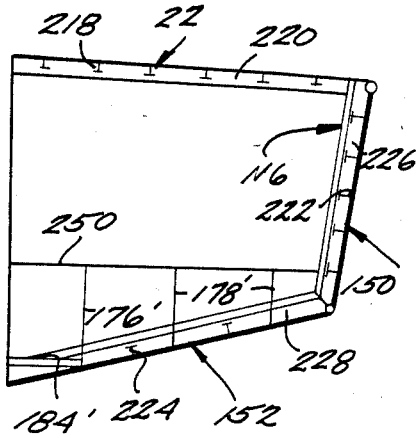
FIG. 12 is a cross-section of the vessel at station 19.

Turning now to FIG. 11, the bulkhead provided at station 17 as set forth and as shown and is shown as comprised primarily of a beam plate member 240 which is again preferably formed from ¼" aluminum plate. As was true with the bulkheads at stations 1 and 10, this bulkhead is also reinforced with angle irons 242 arranged in a network pattern across the face of plate member 240. To provide access between the lazaret 116 and the engine compartment 70, a doorway 244, is provided in the bulkhead and a conventional watertight door (not shown) can again be used to close off that bulkhead in order to make it watertight. As was true with the other bulkheads at stations 1 and 10, the main plate member 242 is suitably welded to both the sides 150 and bottom surfaces 152 of the vessel with the top of plate 240 also being welded to the bottom of the plates forming the cargo decking 22. It is preferred that metallurgical inert gas welding techniques be used although other forms of welding could be used so long as it produced watertight seams in the aluminum plating or whatever other form of plating is used.

As mentioned above, FIG. 12 relates to the cross-section taken at station 19 and represents a view of half of the width of the vessel at that point. As shown, the fuel tanks for on board use were indicated generally at 122 are formed from solid end plates 176' as well as baffles 178'. The floor to the lazaret area above the onboard fuel tanks indicated at 250 is comprised of 3/16" aluminum plating welded in place over the tank structure.

The bulkhead forming the transom will be similar to that shown in FIG. 9, used at station 10, except that there will be no doorway. It is preferred to have the reinforcing structure extend to the marginal edges of the main plate forming the transom and that the plate used for the transom be 5/16" aluminum plate with the reinforcing being comprised of 4"×2"×¼" T's running transversely across the transom and by use of ⅜×6" flat bars on two foot centers running vertically from the bottom to top.

Turning now to FIG. 14, the piping diagram for the various liquid systems is set forth. There are six primary on board liquid systems and included among those are a fuel system, an engine cooling system, a bilge system, a potable water system, an onboard water system and a fire fighting system.

The crash bulkhead at station 3 is shown at 140 and, likewise, bulkheads 200 and 240 at stations 10 and 17 are also respectively shown in FIG. 14.

Thus, beginning at the left of the drawing, the onboard fuel tanks 122 are set forth to the left of bulk head 240 in the lazaret area. Connecting pipe or conduit 184' connects the port and starboard tanks so that liquid levels can be maintained and this conduit also provides the discharge or outlet for these tanks. Each of the tank structures is provided with a fuel fill inlet 260 and a vent line 262.

Generator 104 is a water cooled unit and is provided with its own self contained electric engine (not shown) and fire pump 114 has a separate diesel drive engine indicated at 106. Likewise, the main drive diesels 100 are arranged with one on the port side of the vessel the other on the starboard. Likewise, the air conditioning system 102 is also shown as being on the engine room side of the bulkhead 200 whereas the off board fuel or water tanks, indicated generally at 92, are located between bulkheads 200 and 140.

Returning to the fuel system, there is a fuel manifold indicated at 264 which receives fuel from the onboard fuel tanks 122 via conduit 184', a gate valve 266 from which conduit 268 leads to a gate valve 270 and finally via conduit 272 into a conventional fuel manifold 264. Output conduits 274, 276, 278 and 280 respectively lead to the generator 104, diesel 106 for the fire pump 114 and to each of the two main engines 100. Suitable fuel filters 282 can be used if desired with these fuel filters being manufactured by RACOR.

The engine cooling system would generally include a conduit system to collect sea water through a sea cock, represented at 290 with flow regulated by a valve 292 and conduit 295. Suitable straining devices or filters 294 each of the respective engines will have a return cycle going to an exhaust water jacket 296 from which the cooling water will discharged.

The bilge system includes a conventional bilge manifold 300 and a plurality of conventional bilge pickups or inlets, generally indicated at 302, with one being located in the lazaret area, another adjacent pumps 328 and 340, another one within the main tank storage and another one forward of bulkhead 140. Each of these are connected to the main bilge manifold via conduits 304. A bilge pump 306 is connected to bilge manifold 300 via a conduit 308 and suitable valve means and can be allowed to operate on a continuous or intermittent basis depending upon the desirability at the time the vessel is being used. In any event, bilge pump 306 will discharge overboard via a discharge conduit 310 and a discharge port 312. In addition, bilge pickup can be connected into the engines' water cooling systems which can be accomplished through a suitable conduit 314 and suitable valving, generally indicated at 316, which will connect into the water cooling line 295.

Each of the pairs of tanks 92 are connected to a separate manifold 320 for discharge purposes and each tank in the pair is provided with a tank fill inlet 322 and a vent line 324. As indicated, conduits 184 which provide for uniformity of liquid levels from port to starboard sides also comprise the discharge conduits which are connected through suitable valving, respectively, to manifold 320 by means of discharge conduits 326. Discharge of fluid contained within tanks 92 is controlled by a pump 328 which is connected to manifold 320 by suitable conduits 330. A discharge pump outlet conduit 332 connects the pump 328 into a recessed discharge port 334 which as shown in FIG. 2 is located in the stern or aft portion of the ship, preferably as close to the transom as possible and in this instance is shown as being adjacent hatch 118. By providing the liquid discharge outlet at this point, it is possible for the vessel to be backed into a discharge position with respect to the offshore facility thereby helping assure that deck house 18 and other raised areas on the vessel will not come in contact with that offshore facility.

The onboard water system includes a main water pump 340 which is directly connected to the onboard water supply via conduit 342. As shown in FIG. 14, this onboard water could be contained in the two forward most tanks 92 or it could alternatively in a separate tank structure located elsewhere on board.

Water pump 340 will supply water to a main pressure tank 350 which in turn can supply a water heater 352 from which hot water can be supplied to a washing machine 354, the galley sink 356, shower 358 and lavotory 360. Each of these can receive both hot and cold water via hot water conduit 362 and cold water conduit 364, respecitvely. Also, connected to the pressure tank 350 via the cold water conduit 364 is a toilet 366 which is also connected to suitable sewage disposal system 368 having an outlet 370. The pressure tank 350 can also be connected to two hose bibs, one for the aft and one for the boat 372 and one for the forward end of the boat 374 as well as a water cooler 376 which is provided with a return line for discharge purposes 378 to join a common discharge line 380 and an outlet 382 which also is connected to each of the washer, galley sink, shower and laboratory via suitable conduits.

The fire fighting system is provided with a 5" sea water inlet 390 which leads through suitable valving and filters that include strainers to fire pump 114 and is directed via an output line 392 to a fire station 394 located on the bow of the ship and via a branch conduit 396 to alternate fire stations 398 provided at desired locations amidships or at the aft end of the vessel. Preferably, the fire station located from the fire station 394 located in the bow is a fire gun whereas the remining fire stations 398 can comprise hoses.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims, which scope is to be accorded the broadest interpretation so as to encompass all such modifications and equivalent structures. What we claim is:

1. A crew boat capable of servicing offshore installations comprising the combination of a hull having a rear portion defined by a chine line that remains substantially horizontal from midships rearwardly to the transom and a slight V-shaped bottom with the bottom surfaces defined thereby remaining substantially flat throughout and being angled at a substantially constant angle relative to the vertical center line of said boat, said hull further including side walls extending upwardly from the perimeter of the bottom surfaces with the angle therebetween from midships rearwardly in said rear portion being substantially constant, and a progressively increasing V-shaped hull extending from midships forward, means defining interior tankage space integrally formed with the hull and internal framing thereof for transporting liquid supplies, crew quarters for housing the boat crew and at least a full crew for the offshore installation, fore and aft deck means respectively for defining a multi-story deck house in the fore part of the crew boat and a cargo area aft of the deck house, said interior tankage means including a first portion formed integrally with the hull and extending from midships forward a predetermined distance beneath said deck house means for carrying off-loadable liquid supplies for the off-shore installation and a second portion formed integrally with the hull beneath said cargo area for carrying on board liquid supplies, fire fighting means for fighting a variety of types of fires, a pumping system for suitably pumping liquid supplied on board and off board of said boat and engine means for controlling operation of said boat.

2. A utility boat for providing a source of supplies, crews and support in servicing offshore installations comprising the combination of an outer hull having a V-shaped hull extending forward of midships and rear hull means extending rearwardly from midships for forming a continuous, precise lift when the boat is both sitting and running under all load conditions, said rear hull means being defined by a chine line that remains substantially horizontal from midships rearwardly to the transom and a slight V-shaped bottom with the bottom surfaces defined thereby remaining substantially flat throughout and being angled at a substantially constant angle relative to the vertical center line of said boat, said hull further including side walls extending upwardly from the perimeter of the bottom surfaces with the angle therebetween from midships rearwardly in said rear portion being substantially constant, first and second internal tank means for providing internal storage for off board and on board liquid supplies for re-supplying the offshore installation with the liquid supplied and for providing fuel and water incidental to the boat's operation, respectively, said first internal tank means occupying from about 5% to about 10% of the internal volume of the boat, fire fighting means for fighting fires on other vessels and at said off-shore installations, said fire fighting means including means defining a separate sea water inlet, a deck comprised of a first portion for providing a cargo holding area and a second portion for supporting a deck house, said first portion constituting 60% of said deck, and means defining interior passenger space comprising 45% of the internal volume of the boat and engine means for controlling the operation of said boat.

3. A boat as in claim 2 wherein said angle from midships rearwardly can be in a range of from about 21.5 degrees to about 26.5 degrees.

4. A boat as in claim 3 wherein said rear hull means includes flat side and bottom surfaces and the angle between the bottom surface and a line normal to the vertical center line of the boat can be in a range of from about 11 degrees to about 17 degrees.

5. A boat as in claim 2 wherein said first internal tank means is integrally formed with the hull beneath a predetermined portion of said second portion of said deck.

6. A boat as in claim 5 wherein said first internal tank means includes a bottom surface formed from the bottom of said hull, with the top thereof being formed by the second portion of said decking.

7. A boat as in claim 6 wherein said first internal tank means is divided into port and starboard sections by a pair of spaced apart plates each positioned a predetermined distance from the center of said boat and extending from the bottom of said hull to said deck.

8. A boat as in claim 5, wherein said second internal tank means is integrally formed with the hull beneath a predetermined portion of said first portion of said deck.

9. A boat as in claim 2, wherein said first internal tank means comprise a plurality of pairs of tanks positioned opposite one another on opposite sides of the boat and separated in the center of the boat by an open compartment and located beneath said deck house.

10. A boat as in claim 9, wherein said second internal tank menas comprise a plurality of pairs of tanks positioned opposite one another on opposite sides of the boat and separated by an open compartment at the center line of the boat and located beneath said cargo holding area.

11. A boat as in claim 10, wherein said second internal tank means are located at the rear of said boat.

12. A boat as in claim 2, wherein said first and second internal tank means further includes pumping means for handling the liquid materials contained within said first and second tank means.

13. A boat as in claim 1, wherein said first portion of said interior tankage means comprise a plurality of pairs of tanks positioned opposite one another on opposite sides of the boat and separated in the center of the boat by an open compartment and located beneath said deck house.

14. A boat as in claim 1, wherein said second portion of said interior tankage means comprise a plurality of pairs of tanks positioned opposite one another on opposite sides of the boat and separated by an open compartment at the center line of the boat and located beneath said cargo holding area.

15. A boat for offshore use comprising hull means for producing a continuous, precise lift, said hull means being characterized by a chine line on each side of the hull that remains substantially horizontal from a predetermined point midship to the transom and a bottom from midships aft comprised of two substantially flat surfaces that together form a slight V-shaped cross-section defining thereby the keel, said flat surfaces being angled at a substantially constant angle relative to the vertical center line of said boat, said hull means further including fore and aft extending side walls extending upwardly from the outer sides of said flat surfaces with the angle therebetween from midships rearward being substantially constant so that the vertical distance between the keel and a horizontal line connecting the chine line on each side of the hull remains substantially constant.

16. A boat as in claim 15, wherein said hull is further characterized by a progressively increasing V-shaped hull from a predetermined point midship forward.

* * * * *